United States Patent [19]

Donnelly

[11] Patent Number: 4,722,740

[45] Date of Patent: Feb. 2, 1988

[54] DISPERSIONS OF COAL IN WATER USEFUL AS A FUEL

[75] Inventor: Richard G. Donnelly, Mission Viejo, Calif.

[73] Assignee: OXCE Fuel Company, Windsor, Conn.

[21] Appl. No.: 429,660

[22] Filed: Sep. 30, 1982

[51] Int. Cl.[4] ..... C10L 1/32

[52] U.S. Cl. ..... 44/51; 252/351; 252/356

[58] Field of Search ..... 44/51; 406/47, 49, 197; 252/351, 356

[56] References Cited

U.S. PATENT DOCUMENTS

| | | | |
|---|---|---|---|
| 2,346,151 | 4/1944 | Burk et al. | 44/51 |
| 4,125,382 | 11/1978 | O'Brien et al. | 44/51 |
| 4,295,859 | 10/1981 | Boehmke | 44/51 |
| 4,358,293 | 11/1982 | Mark | 44/51 |
| 4,375,358 | 3/1983 | Swartz et al. | 44/51 |

FOREIGN PATENT DOCUMENTS

| | | | |
|---|---|---|---|
| 0050412 | 4/1982 | European Pat. Off. | 44/51 |

*Primary Examiner*—William R. Dixon, Jr.
*Assistant Examiner*—Margaret B. Medley
*Attorney, Agent, or Firm*—Walter A. Hackler; Robert J. Baran

[57] ABSTRACT

A dispersion of coal in water includes particulate coal dispersed in an aqueous solution including a multi-component additive. The multi-component additive includes a water-soluble, nonionic wetting agent, a water-soluble, low molecular weight polymer, and a water-soluble, medium-to-high molecular weight polymer. The particulte coal has a particle size distribution with a major portion of particulate coal having a weight average particle size of from about 75 μm to about 35 μm and a minor portion of particulate coal having an average particle size of about 6 μm to about 15 μm.

16 Claims, 2 Drawing Figures

FIG. 1.
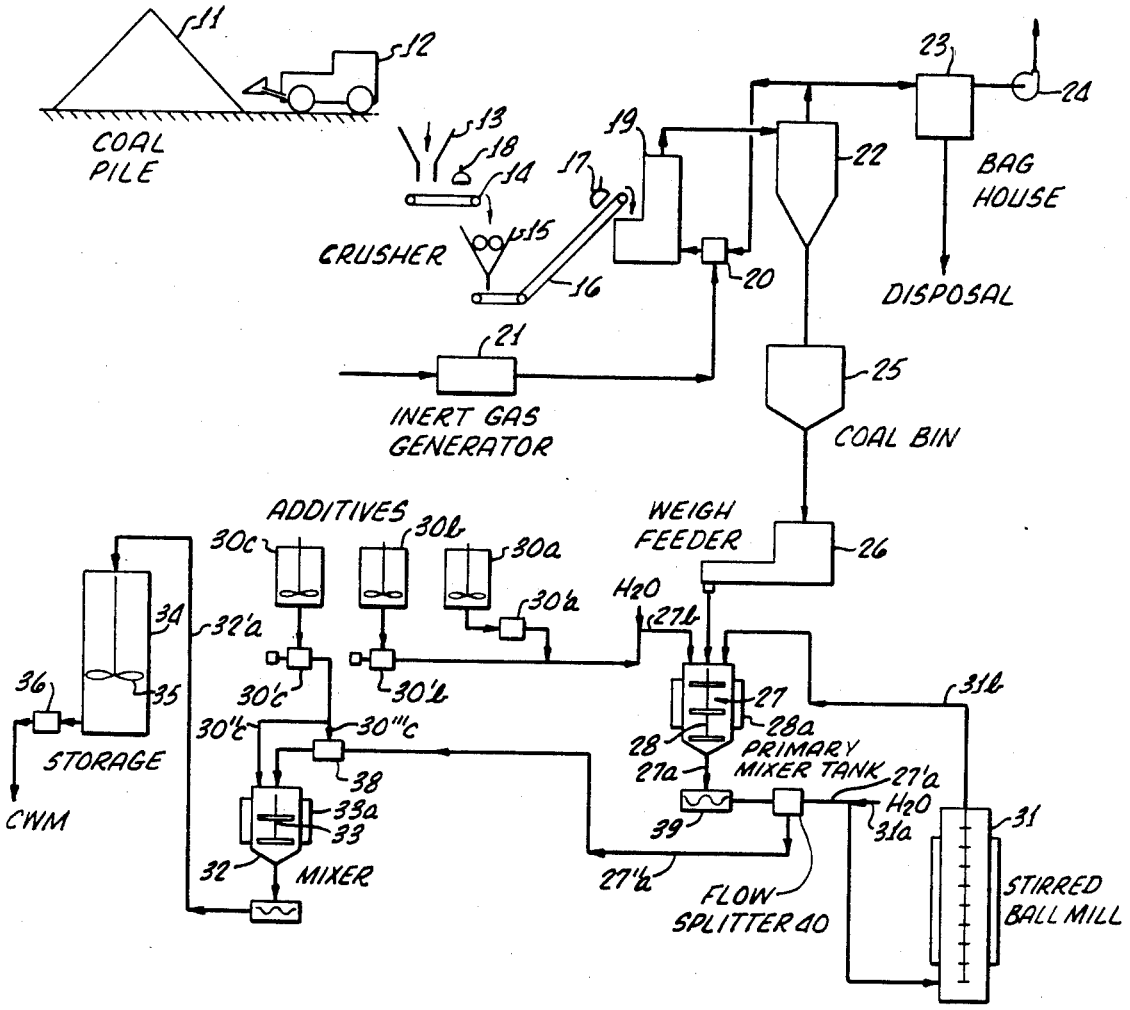
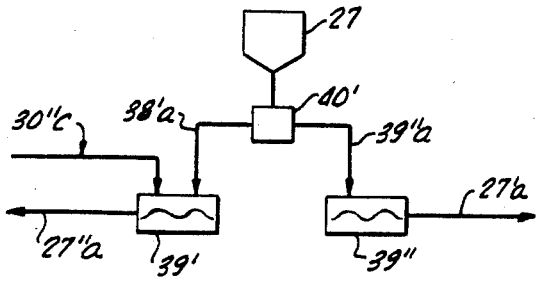
FIG. 2.

DISPERSIONS OF COAL IN WATER USEFUL AS A FUEL

FIELD OF THE INVENTION

The instant invention relates to a dispersion of coal in water which comprises particulate coal dispersed in an aqueous solution, which solution comprises a multi-component additive. The multi-component additive comprises (a) water-soluble, nonionic wetting agent,
(b) a water-soluble, low molecular weight polymer, and
(c) a water-soluble, medium-to-high molecular weight polymer.

The above dispersion is useful as a fuel, e.g. as a substitute for residual oil or coal. The instant dispersion being fluid combines the economy of coal as a boiler fuel with the ease of transportation and combustion of residual oil.

BACKGROUND OF THE PRIOR ART

The use of dispersions of coal in water or oil as a fuel in place of residual oil is well known. The objective in using such dispersions is to take advantage of the economy and availability of coal in a fluid fuel which can be easily transported and atomized for combustion. Of course, since the objective is to replace fuel oil, the dispersions of coal in water are of especial interest, provided that such dispersions can be loaded with sufficient coal to avoid a significant fuel value debit.

Dispersions of coal tend to sediment while quiescent. (That is, the particulate coal settles to the bottom of a storage tank, resulting in a non-homogeneous dispersion.) Such non-homogeneous dispersions are difficult to burn efficiently as the fuel value will vary with amount of particulate coal that is found in the dispersion. Dispersions of coal may therefore be agitated continuously or made up just prior to use to avoid sedimentation problems. Both approaches are not completely satisfactory, and in fact at times it is impossible to redisperse sedimented coal without heroic efforts.

Various methods have been utilized to stabilize dispersions of coal and to allow redispersion of the coal without expending large amounts of mechanical energy. For example, it is known that more finely ground coal is easier to disperse and also once such finely ground coal is dispersed, it exhibits a tendency to avoid sedimentation. Therefore, one approach to stabilizing dispersions of coal has been to grind the coal to a very fine average particle size.

Intensive grinding requires very large amounts of mechanical energy, and therefore to some extent defeats the economical advantage of using coal dispersions in place of residual or fuel oil. That is, the major reason that it is desirable to substitute dispersions of coal for fuel oil in boilers and other combustion means is that coal is more economical and more highly available energy source than fuel oil. Thus, a process requiring the input of energy to more finely grind the coal is somewhat counterproductive.

It is also known that increasing viscosity of the coal dispersions provides resistance to sedimentation. However, the higher viscosity dispersions are difficult to handle and burn. That is, it is well known that above a certain viscosity it is difficult to transport coal-dispersions between storage vessels and combustion facilities. Moreover, efficient burning requires complete atomization in the combustion zone of the boiler. High viscosity hinders such complete atomization. Therefore, although high viscosity coal dispersions are resistant to sedimentation, the problems caused by such high viscosity may outweigh the benefits.

Various investigators have utilized additives to overcome the above problems. For example, Krause et al, in U.S. Pat. No. 4,101,293 teach that dispersions of coal in fuel oil may be made stable to storage by incorporating a stabilizer prepared by reacting blends of unsaturated aliphatic and cycloaliphatic carboxylic acids with alkali metal hydroxides or amines. The dispersions taught in such patent are limited to oil continuous dispersions unlike the dispersions of the present invention and are loaded with no more than 50%, by weight, coal. Moreover, it is clear (as discussed below) that the incorporation of alkali metal or nitrogen moieties (from the alkali metal hydroxide and the amine, respectively) is undesirable from the standpoint of ash handling and pollution.

Meyer, in U.S. Pat. No. 4,130,400, avoids the use of an additive which causes pollution and ash handling problems, by means of an additive comprising a copolymer of alkylstyrene. Such additive would not be effective in stabilizing dispersions of coal in water since it is insoluble in water. In fact, the patentee notes that one of the objects of his invention is to avoid the incorporation of water in the disclosed dispersions.

Yamamura et al, in U.S. Pat. No. 4,330,301, discloses that a sulfonated polynuclear dispersant is useful in dispersing coal in water. Again, the utilization of sulfur moieties and the sodium, calcium, ammonium salt neutralizing agents, as taught by the patentees is undesirable from a pollution and ash handling standpoint.

Braun et al, in U.S. Pat. No. 4,242,098, teaches that the addition of small amounts of water-soluble polymers to aqueous coal slurries permit formulation of a mobile slurry containing up to 78% coal. The water-soluble polymers which can be used include poly(ethylene oxide), partially hydrolyzed poly(acrylamide), hydroxyethyl cellulose, quaternary nitrogen-substituted cellulose ethers, xanthan gum, hydroxypropyl guar gum, and carboxymethyl hydroxypropyl guar gum. The patentee is only concerned with transporting coal wherein the dispersion is continuously agitated and does not consider the use of multi-component additive systems to provide a dispersion of coal in water which is stable to storage, and easy to burn, as well as easy to transport.

Finally, Burgess, in U.S. Pat. No. 4,304, 573, indicates that the prior art worker will go to an extreme to prepare dispersions of coal. The indicated approach requires the graft polymerization of monomers on the coal surface to render such surface hydrophobic and oleophilic. No such extreme is contemplated in the process of the instant invention.

SUMMARY OF THE INVENTION

The instant invention relates to a dispersion of coal in water which comprises particulate coal dispersed in an aqueous solution comprising a multi-component additive, which multi-component additive comprises (a) a water-soluble, nonionic wetting agent,
(b) a water-soluble, low molecular weight polymer, and
(c) water-soluble, medium-to-high molecular weight polymer.

More particularly, the instant invention relates to a dispersion of coal in water which comprises from about 60 to about 80%, by weight, particulate coal dispersed in an aqueous solution, said aqueous solution comprising a multi-component additive, soluble therein, wherein said multi-component additive comprises (a) from about 0.1 to about 2.5%, by weight, of a water-soluble nonionic wetting agent selected from the group consisting of reaction products of alkyl radical substituted phenol and an epoxide, said alkyl radical having from about 8 to about 12 carbon atoms and said epoxide being selected from the group consisting of ethylene oxide, propylene oxide and mixtures thereof, said reaction products having an HLB of from about 10 to about 19;

(b) from about 0.01 to about 0.3%, by weight, of a water-soluble, low molecular weight polymer selected from the group consisting of polyols selected from the group represented by the general formula

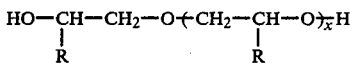

wherein R is independently selected from the group consisting of methyl, and hydrogen radicals and x is an integer selected to provide a polymer having a molecular weight of from about 400 to about 1200; and (c) from about 0.01 to about 0.4%, by weight, of a water-soluble medium-to-high molecular weight polymer selected from the group consisting of ethyoxylated cellulose, propoxylated cellulose, acrylic acid polymers, starch, xanthan gum, guar gum, polyvinyl alcohol, and mixtures thereof.

In a preferred embodiment, the above dispersion of coal in water is prepared by a novel method which comprises:

(a) combining (i) an aqueous solution comprising a water-soluble, non-ionic wetting agent and a low molecular weight polymer; (ii) a first dispersion of coal in water, said first dispersion comprising a first portion of particulate coal having a weight average particle size of from about 6 to 15 μm; and (iii) a second portion of particulate coal having a weight average particle size of from about 35 to about 75 μm to provide a second dispersion of coal in water, said second dispersion comprising from about 10 to about 33%, by weight coal, of said first portion of particulate coal, and (b) combining an aqueous solution comprising a water-soluble, medium-to-high molecular weight polymer with said second dispersion to provide a third dispersion of coal in water, said third dispersion being characterized as having a viscosity suitable for pumping and atomization in a burner nozzle and as resistant to sedimentation and hard packing for extended periods of time.

More preferably, said second dispersion of coal in water is divided into two portions, the first portion, comprising from about 10 to about 33% by weight coal of said second dispersion is milled to comminute the particulate coal dispersed therein to a weight average particle size of from about 6 to about 15 μm and said milled dispersion is recycled to the above process as said first dispersion of coal in water. The remainder of said second dispersion of coal in water, after combining with the aqueous solution of a water-soluble medium-to-high molecular weight polymer, may be recovered as product.

The term HLB referred to herein is the hydrophilelipophile balance as is well known and discussed in Becher, EMULSIONS, Reinhold Publishing Corporation, New York, 1957.

BRIEF DESCRIPTION OF THE DRAWINGS

The present invention would be more readily understood by reference to the drawings in which:

FIG. I is a schematic drawing of the process of the present invention, and

FIG. II is a block drawing alternatively showing the dispersion from a primary mixer tank being splitted by a flow splitter.

DETAILED DESCRIPTION OF THE INVENTION

The instant invention may be conveniently understood by reference to the following figure. Prepared coal (11) having particles generally smaller than 3 inches in diameter is transferred by means (12) for example a truck to a feed hopper (13). Feed hopper (13) is utilized to pass the coal to a conveyer belt (14) which delivers the coal to crusher (15). The coal is crushed in crusher (15) to a particle size generally smaller than $\frac{3}{8}$ inch diameter. The crushed coal is passed from crusher (15) to conveying means e.g., conveyer belt (16) where it is passed into contact with the magnetic field of a magnetic separator (17) which is utilized to removed any tramp iron. (Additional magnetic separator (18) may be utilized at conveyer (14) to assist in the removal of iron prior to crushing.) The crushed coal (depleted in particulate iron) is metered to mill (19). In mill (19), which may be a ball mill or a bowl mill or any of a number of well-known mills, the coal is crushed to a weight average particle size of about 75 μm to 35 μm. Such crushing in mill (19) is carried out in the presence of an inert gas. For example, air and fuel is passed into an inert gas generator (21) wherein fuel is combusted to a gaseous product comprising carbon dioxide and water. Such gaseous product carries with it the excess oxygen fed to the combuster and the unburned nitrogen. The gaseous product is combined with air fed with the coal and from other sources to insure that the oxygen concentration is such that rapid or explosive oxidation of the freshly ground coal does not occur. Such inert gas atmosphere is then passed in admixture with air through compressor (20) into mill (19). The crushed coal from mill (19) is then passed into cyclone (22) wherein fines are passed therefrom as overhead into a fine particulate collection device, such as a bag house (23). The underflow from the bag house (23) is passed to disposal. The overflow from the bag house (23), which in a substantially particulate-free gas stream containing air and the inert gas which is utilized to convey the coal from mill (19) to cyclone (22), is passed through compressor (24) and is recylced to the coal mill (19). The underflow from cyclone (22) is passed to coal bin (25) for storage. The coal from coal bin (25) which will have a weight average particle size of about 75 μm to about 35 μm is passed into a weighing zone, i.e., weigh feeder (26) wherein a suitable amount of coal for preparing the slurry of the instant invention is metered into the primary mixer (27). The particle size hereinabove-referred to as "weight" average particle size is a well-known basis of percentage and is discussed in Perry and Chilton, CHEMICAL ENGINEER'S HANDBOOK, 5th Ed., (1973) pages 8-3 and 8-4 . Primary mixer (27) is fitted with mixing means (28) and heating/cooling means (28*a*). Water is passed into primary mixer (27) through line (27 B). In addition, there is an array of additive tanks (30 A, and B) which are in fluid communication with primary mixer (27). In additive tank (30 A) the wetting agent noted above is combined with water to provide a solution which is passed into primary mixer (27) by means of pump (30′ A). For example, an aqueous solution of 70% of the preferred ethoxylated alkylphenol may be made up in additive tank (30 A) and passed into mixer (27) for preparation of coal slurry. Similarly, in additive tank (30 B) a low molecular weight water soluble polymer solution is made up by mixing polypropylene gylcol with water to provide a solution comprising 10% by weight of the low molecular weight polymer. This solutlon is passed into mixer (27) by means of pump (30′ B). Also added to primary mixer (27) is an aqueous slurry of finely ground coal returning from fine grinder (31), as described further below. The input to mixer tank (27) including the weighed coal from weigh feeder (26), water through line (27 B), additives from additives tanks (30 A) and (B) and a slurry of the finely ground coal from fine grinder (31) are combined to form a solution comprising approximately 70% by weight coal. The materials are retained in mixer (27) for a sufficient time to obtain a homogeneous dispersion. The dispersion from primary mixer (27) is passed through line (27 A) and pump (39) and is divided into two streams by flow splitter (40) and passed through lines (27′ A) and (27″ A). Mixer tank (27) is in fluid communication with fine grinder (31) through lines (27 *a*) and (27′ *a*). Water and additional additives such as additional wetting agent and low molecular weight water soluble polymer may be provided as a solution through line (31 *a*). Preferably the split made at flow splitter (40) will provide 10 to 33% by weight of the dispersion of coal in water flowing thru line (27*a*) to fine grinder (31) and the remainder to conditioning mixer (32) described below.

In fine grinder (31) the particulate size of the coal is reduced further to a weight average particle size of within the range 6 μm to 15 μm. The dispersion or effluent from the fine grinder (31) which may comprise about 50% by weight of finely ground coal is returned to the primary mixer (27) by means of line (31*b*) where it is combined with the slurry formed within mixing tank (27). The purpose of combining the effluent from fine grinder (31) with the slurry in primary mixer (31) is to provide a fraction of particles having a very small particle size in combination with the larger particles of coal found in the dispersion that is prepared in the mixing tank (27). In general, the metering is carried out so that the effluent from the primary mixer (27) which passes through line (27″ A) into conditioning mixer (32) will comprise a slurry wherein the coal portion of which has about 25% by weight of coal that has passed through the fine grinder (31). Thus, a slurry having about 17.5% by weight of a weight average particle size 6 μm to 15 μm coal and 52.5% by weight of a weight average particle size 35 μm to 75 μm coal is passed to the conditioning mixer (32) which is fitted with mixing means (33) and heating/cooling means (33*a*). Conditioning mixer (32) is in fluid communication with additive tank (30 C) through pump means (30′ C) and line (30″ C). Alternatively, the aqueous solution of additive C may be combined with the coal dispersion passing thru line (27″ *a*) in in-line mixer (38) prior to passage to mixer (32). It is important to note that the medium-to-high molecular weight makes it difficult to fully disperse additive C within the coal dispersion. Therefore the alternative of passing the solution from additive (30 C) through in-line mixer (38) rather than directly into mixer (32) is preferred. Also the same medium-to-high molecular weight requires that additive C not be sent through the fine grinder (31) wherein the conditions of shear necessary for fine grinding would degrade the molecular weight of additive C.

In additive tank (30 C) an aqueous solution of a water soluble medium-to-high molecular weight polymer such as hydroxyethyl cellulose is prepared. The solution comprises about 1 weight percent of said high molecular weight polymer. Mixing is continued in conditioning mixer (32) until a slurry having a 25° C. viscosity of about 1000 to 6000 centipoise, (as measured using, for example, a Brookfield viscometer or a Haake viscometer at typical pipe flow shear rates), a 25° C. specific gravity of 1.20 to 1.28, and stability against sedimentation of 30 days or more is prepared. The preferred slurry is shear-thinning, i.e., pseudoplastic and/or thixotropic as contrasted with dilatant slurries.

This slurry is passed via fluid communication means (32′ A) to storage tank (34). Such storage tanks may be fitted with mixing means (35) to maintain the slurry in dispersion. The slurries of the instant invention however do not necessarily require such mixing means since they are stable against sedimentation. The dispersion of coal in water which is stored in tank (34) may be passed through outlet means (36) and utilized for fuel.

Alternatively, as shown in FIG. 2 the dispersion from primary mixer tank (27) may be split by flow splitter (40′) (in the proportions preferred above) and the stream passing to mixer (32) combined with the solution of additive C in in-line mixer 39′ prior to passing to said mixer 32. The alternate of FIG. 2 is also preferred method of insuring dispersion of additive C in the coal dispersion without degradation of molecular weight.

Each of the above mixers and tanks are known in the art devices, for example, turbine mixers, etc. may be utilized. The methods and materials of fabrication of suitable fluid communication means, tanks, mixers, etc. are well known in the art and need not be discussed further.

The resulting dispersion of coal in water will have a viscosity of less than 6000 centipoise and be pseudoplastic and/or thixotropic which makes it amenable to pumping and atomization in burner nozzles. Such dispersion is also resistant toward sedimentation and hard packing for extended periods, for example, over thirty days, when stored at temperatures of 30° C. or less.

The instant invention utilizes a novel non-ionic three component additive system which insures the absence of sodium, potassium, calcium and ammonium ions which potentially interfere in a deleterious matter with the ash properties of coal during combustion by rendering the ash combustion products more slagging, more fouling and/or more corrosive in nature. Furthermore, the absence of nitrogen moieties enables preparation of coal slurries having less environmental impact. The above salt moieties provide more ash since such salts usually wind up as a component of the ash.

The three component additive system allows for independent adjustment of the performance properties of the final dispersion of coal in water. The wetting agent, i.e., the non-ionic surfactant, primarily affects pumpability at all rates of shear and at intermediate and long durations of shear. The low molecular weight water-soluble polymer contributes to easy redispersability upon eventual sedimentation and resists degradation of rheology properties during long term pumping. The medium-to-high molecular weight water soluble polymer causes the particulate coal to interlock in a network which ensures stability at low rates of shear, but has relatively minor affect on pumpability at medium and high rates of shear and at intermediate and long durations of shear. In addition, the wetting agent in combination with the low molecular weight water soluble polymer is resistant to shear degradation and therefore may be utilized in the primary mixer (27) and/or the fine grinder (31). In contradistinction the medium-to-high molecular weight water soluble polymer is less resistant to shear; therefore it is added in conditioning mixer (32) wherein the rate and duration of shear is insufficient to degrade molecular weight of said high molecular weight polymer.

The controlled distribution of particulate coal generated by mixing fine and coarse grinds of various sizes in various ratios provides additional stability and loading of the above dispersions. The fine particulate coal orients in the space between the coarse particulate coal and therefore increases the loading. Moreover the fine particulate coal may increase the mobility of the large particulate coal by lubricating the passage of large coal particles over each other.

The following examples are preferred embodiments of the instant invention.

EXAMPLE 1

A dispersion of coal and water having 68% by weight coal is prepared by means of the above process. The weight ratio of the coarse to fine particulate coal is three to one. The weight average particle size of the coarse coal is 45 μm and the weight average particle size of the fine coal is 8 μm. Dry coarse coal in 51 parts is mixed with: i) a 50% slurry of fine coal in 34 parts; ii) 1 part of an aqueous solution comprising 70 weight % of nonylphenolethoxylate having 40 moles ethylene oxide; iii) 1 part of an aqueous solution of 10 weight % of polypropyleneglycol having molecular weight of about 400; and iv) 8 parts of additional water. The resulting slurry is mixed in a mixing tank or other mixer such as primary mixer (27) and then passed into a mixing tank or other mixer such as conditioning mixer (32), wherein 5 parts of an aqueous solution of 2 weight % hydroxy ethylcellulose having viscosity of about 5000 cp at 25° C. is added to the slurry with agitation. A defoamer or antifoamer such as a polysiloxane, for example polydimethylsiloxane, is also added to said primary mixer. A biocide such as 1,2-benzisothiazolin-3-one may be added to such dispersion at a level of about 0.1% by weight. The resulting dispersion of coal in water has the following characteristics:

The viscosity of the dispersion as measured using a Brookfield or Haake viscometer is 1200 to 1800 centipoise at 25° C. and at a shear rate of 100 (seconds)$^{-1}$. The dispersion reduces in viscosity with increasing rate of shear and with increasing duration of shear. That is, the dispersion is psuedoplastic and thixotropic as contrasted with the more common dilatant dispersions which thicken as shear rate increases. The viscosity increases at temperatures well below and well above 25° C., but the dispersion remains pumpable at 1° C. and at 60° C. The specific gravity of the dispersion is 1.25° at 25° C. The dispersion remains stable against sedimentation for a minimum of 90 days when stored in the laboratory in a non-agitated state at 25° C. Any sediment which forms over this period and up to at least 120 days under these conditions is readily redispersible. The dispersion remains fluid and non-sedimenting after long durations (in excess of two hours) of high speed shearing. The dispersion has nearly identical rheological properties after multiple cycles of freezing and thawing. The dispersion resulting from this formulation will adequately atomize and will burn in test furnaces operated according to accepted practice. This dispersion exhibits high combustion efficiency (99+% carbon burnout) and acceptable flame stability under reasonable combustion conditions in such test furnaces.

In comparison, another coal dispersion in water is made up in a manner similar to the previous dispersion except that the loading is 65% by weight of a single size grind coal having a weight average particles size of 45 μm. The antifoam is added at a weight of 0.05% based on the dispersion. The viscosity is 1800 to 2100 centipoises at a shear rate of 100 seconds −1. However, without the fines the stability to storage at room temperature is only about 60 days. The stability for both samples is measured by observing the tendency for coal to accumulate on the bottom in non-agitated samples held in bottles of diameter at least 10 cm. The duration of stability is that time by which 2% by weight of the coal has settled.

What is claimed is:

1. A dispersion of coal in water comprising particulate coal dispersed in an aqueous solution with a multicomponent additive, said dispersion comprising from about 60 to about 80 percent by weight coal, said multicomponent additive comprising (a) a water-soluble, nonionic wetting agent, said water soluble, nonionic wetting agent being selected from the group consisting of reaction products of alkyl radical substituted phenol and an epoxide, said alkyl radical having from about 8 to about 12 carbon atoms and said epoxide selected from the group consisting of ethylene oxide, propylene oxide and mixtures thereof, said reaction products having an HLB of from about 10 to about 19, (b) a water-soluble, low molecular weight polymer, said water-soluble, low molecular weight polymer being selected from group consisting of polyols selected from a group represented by the general formula $$HO-\underset{\underset{R}{|}}{CH}-CH_2-O-(CH_2-\underset{\underset{R}{|}}{CH}-O)_xH, \text{ and}$$

wherein R is independently selected from the group consisting of methyl, and hydrogen radicals and x is an integer selected to provide a polymer having a molecular weight of from about 400 to about 1200, and (c) a water-soluble, medium-to-high molecular weight polymer, said water-soluble medium-to-high molecular weight polymer being selected from a group consisting of ethoxylated cellulose, propoxylated cellulose, polyacrylic acid, starch, xantham, gum, guar gum, polyvinyl alcohol and mixtures thereof.

2. The dispersion of claim 1 wherein said coal comprises a controlled particle size distributiion wherein a major portion of said particulate coal has a weight average particle size of from about 75 μm to about 35 μm and a minor portion of said particulate coal has an average particle size of from about 6 μm to about 15 μm.

3. The dispersion of claim 2 wherein the ratio of said major to said minor portion varies from about 2 to 1 to about 10 to 1, by weight.

4. The dispersion of claim 1 wherein R is a methyl radical.

5. The dispersion of claim 4 wherein said water-soluble, medium-to-high molecular weight polymer is hydroxyethyl cellulose.

6. The dispersion of claim 5 wherein said water-soluble, nonionic wetting agent is selected from the group consisting of an ethylene oxide adduct of nonyl phenol comprising about 40 moles of ethylene oxide per mole of nonyl phenol and an ethylene oxide adduct of octyl phenol comprising about 9 moles of ethylene oxide per mole of nonyl phenol.

7. A dispersion of coal in water which comprises from about 60 to about 80%, by weight, particulate coal dispersed in an aqueous solution, said aqueous solution comprising a multi-component additive, soluble therein, wherein said multi-component additive comprises (a) from about 0.1 to about 2.5%, by weight, of a water-soluble nonionic wetting agent selected from the group consisting of reaction products of alkyl radical substituted phenol and an epoxide, said alkyl radical having from about 8 to about 12 carbon atoms and said epoxide selected from the group consisting of ethylene oxide, propylene oxide and mixtures thereof, said reaction products having an HLB of from about 10 to about 19, (b) from about 0.01 to about 0.3%, by weight, of a water-soluble, low molecular weight polymer selected from the group consisting of polyols selected from the group represented by the general formula

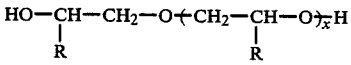

wherein R is independently selected from the group consisting of methyl, and hydrogen radicals and x is an integer selected to provide a polymer having a molecular weight of from about 400 to about 1200; and, (c) from about 0.01 to about 0.4%, by weight, of a water-soluble, high molecular weight polymer selected from the group consisting of ethoxylated cellulose, propoxylated cellulose, acrylic acid, starch, xanthan gum, guar gum, polyvinyl alcohol, and mixtures thereof.

8. A method for preparing a dispersion of coal in water which comprises the steps of:

(a) combining (i) an aqueous solution comprising a water-soluble, nonionic wetting agent and a low molecular weight polymer; (ii) a first dispersion of coal in water, said first dispersion comprising a first portion of particulate coal having a weight average particle size of from about 6 to 15 μm; and (iii) a second portion of particulate coal having a weight average particle size of from about 35 to about 75 μm to provide a second dispersion of coal in water, said second dispersion comprising from about 10 to about 33%, by weight coal, of said first portion of particulate coal, (b) dividing said second dispersion into two portions, a first portion comprising from about 10 to about 33%, by weight coal of said second dispersion, milling said first portion to comminute the particulate coal dispersed therein to a weight average particulate size of from about 6 to about 15 μm and recycling said milled dispersion to step (a) as said first dispersion, and (c) combining an aqueous solution comprising a water-soluble, high molecular weight polymer with said second dispersion to provide a third dispersion of coal in water, said third dispersion being characterized as having a viscosity suitable for pumping and atomizing in a burner nozzle and resistant to sedimentation and hard packing for extended periods of time.

9. A dispersion of coal in water which comprises from about 60 to about 80%, by weight, particulate coal dispersed in an aqueous solution, said coal having a controlled particulate size distribution wherein a major portion of said particulate coal has an average particulate size of from about 75 μm to about 35 μm and a minor portion of said particulate coal has an average particle size of from about 6 μm to about 15 μm, and said aqueous solution comprises a multi-component additive, soluble therein, wherein said multi-component additive comprises (a) from about 0.1 to about 2.5%, by weight, of a water-soluble non-ionic wetting agent selected from the group consisting of reaction products of alkyl radical substituted phenol and an epoxide, said alkyl radical having from about 8 to about 12 carbon atoms and said epoxide selected from the group consisting of ethylene oxide, propylene oxide and mixtures thereof, said reaction products having an HLB of from about 10 to about 19, (b) from about 0.01 to about 0.3%, by weight, of a water-soluble, low molecular weight polymer selected from the group consisting of polyols selected from the group represented by the general formula

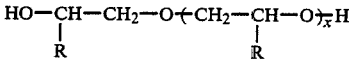

wherein R is independently selected from the group consisting of methyl, and hydrogen radicals and x is an integer selected to provide a polymer having a molecular weight of from about 400 to about 1200; and, (c) from about 0.01 to about 0.4%, by weight, of a water-soluble, high molecular weight polymer selected from the group consisting of ethoxylated cellulose, propoxylated cellulose, acrylic acid, starch, xantham gum, guar gum, polyvinyl alcohol, and mixtures thereof.

10. The dispersion of claim 9, wherein R is methyl and said water-soluble, high molecular weight polymer is hydroxyethyl cellulose.

11. The dispersion of claim 1 wherein said water-soluble, nonionic wetting agent is selected from the group consisting of reaction products of alkyl radical substituted phenol and an epoxide, said alkyl radical having from about 8 to about 12 carbon atoms and said epoxide selected from the group consisting of ethylene oxide, propylene oxide and mixtures thereof, said reaction products having an HLB of from about 10 to 17.8.

12. The dispersion of claim 1, wherein said water-soluble, nonionic wetting agent is selected from the group consisting of nonionic surfactants having an HLB of from about 10 to 17.8.

13. The dispersion of claim 9 wherein said water-soluble, nonionic wetting agent is selected from the group consisting of nonionic surfactants having an HLB of from about 10 to 17.8.

14. The dispersion of claim 10 wherein said water soluble, nonionic wetting agent is selected from the group consisting of nonionic surfactants having an HLB of from about 10 to 17.8.

15. The method of claim 8 wherein said water-soluble, nonionic wetting agent is selected from the group consisting of nonionic surfactants having an HLB of from about 10 to 17.8.

16. The method of claim 15 wherein said water-soluble nonionic wetting agent is selected from the group consisting of reaction products of alkyl radical substituted phenol and an epoxide, said alkyl radical having from about 8 to about 12 carbon atoms and said epoxide selected from the group consisting of ethylene oxide, propylene oxide and mixtures thereof.

* * * * *